US011525312B2

(12) United States Patent
Desormeaux, Sr.

(10) Patent No.: US 11,525,312 B2
(45) Date of Patent: Dec. 13, 2022

(54) OILFIELD CASING CENTRALIZATION TOOL

(71) Applicant: John Barry Desormeaux, Sr., New Iberia, LA (US)

(72) Inventor: John Barry Desormeaux, Sr., New Iberia, LA (US)

( * ) Notice: Subject to any disclaimer, the term of this patent is extended or adjusted under 35 U.S.C. 154(b) by 3 days.

(21) Appl. No.: 17/224,050

(22) Filed: Apr. 6, 2021

(65) Prior Publication Data

US 2021/0310317 A1 Oct. 7, 2021

Related U.S. Application Data

(60) Provisional application No. 63/005,665, filed on Apr. 6, 2020.

(51) Int. Cl.
*E21B 17/10* (2006.01)
*E21B 17/042* (2006.01)
*E21B 33/02* (2006.01)

(52) U.S. Cl.
CPC ..... *E21B 17/1078* (2013.01); *E21B 17/042* (2013.01); *E21B 33/02* (2013.01)

(58) Field of Classification Search
CPC .... E21B 17/1078; E21B 17/042; E21B 33/02; E21B 33/038; E21B 19/06
See application file for complete search history.

(56) References Cited

U.S. PATENT DOCUMENTS

| | | | | |
|---|---|---|---|---|
| 3,180,617 | A | 4/1965 | Brown | |
| 3,427,048 | A | 2/1969 | Brown | |
| 6,068,310 | A * | 5/2000 | Fuller | B66C 1/66 294/215 |
| 6,289,993 | B1 * | 9/2001 | Dallas | E21B 33/068 166/85.4 |
| 6,666,266 | B2 | 12/2003 | Starr et al. | |
| 8,590,485 | B2 * | 11/2013 | Biloiu | H01J 37/08 118/723 MR |
| 8,622,121 | B2 * | 1/2014 | Udipi | E21B 33/068 166/97.1 |
| 2018/0038186 | A1 * | 2/2018 | Ross | E21B 33/068 |

* cited by examiner

*Primary Examiner* — Yong-Suk (Philip) Ro

(57) ABSTRACT

An oilfield casing centralization tool allows a user to center the casing to install the casing hanger into the bowl profile of a wellhead to support the weight of the casing which can exceed over one million pounds. The oilfield casing centralization tool includes a push jack assembly, an anchoring jack assembly, and an elongated structural member. The anchoring jack assembly allows a user to fully secure the oilfield casing centralization tool to a bolt hole of the wellhead. With the oilfield casing centralization tool fully secured to the wellhead, the push jack assembly allows a user to push the casing a desired distance in order to center the casing within a wellbore. The elongated structural member serves as a rigid hub for the push jack assembly and the anchoring jack assembly.

19 Claims, 7 Drawing Sheets

OILFIELD CASING CENTRALIZATION TOOL

The current application claims a priority to the U.S. Provisional Patent application Ser. No. 63/005,665 filed on Apr. 6, 2020.

FIELD OF THE INVENTION

The present invention relates generally to oilfield equipment. More specifically, the present invention is an oilfield casing centralization tool that allows a user to center the casing to install the casing hanger into the bowl profile of a wellhead to support the weight of the casing which can exceed over one million pounds.

BACKGROUND OF THE INVENTION

Natural resources such as, oil or coal, are extracted from the earth in order to be converted into energy in various applications. An oil or mining rig is required in order to extract the natural resources from the earth. Oil or mining rigs require the installation of a casing in order to prevent the formation wall from caving into the wellbore and to isolate the different formations to prevent the flow or crossflow of formation fluid. Installing the casing can be a difficult task due to various reasons. One reason being that the casing must be centered for the installation of a casing hanger into the bowl profile of a wellhead to support the weight of the casing which can exceed over one million pounds. Currently, there is no easy and safe method in order to center the casing within the wellbore.

It is therefore an objective of the present invention to provide an oilfield casing centralization tool that allows a user to center the casing to install the casing hanger into the bowl profile of a wellhead to support the weight of the casing which can exceed over one million pounds. The present invention includes a push jack assembly and an anchoring jack assembly in order to center the casing within the wellbore. The anchoring jack assembly allows a user to fully secure the present invention to a bolt hole of a wellhead. With the present invention fully secured to the wellhead, the push jack assembly is used to push the casing a desired distance in order to center the casing within the wellbore.

DETAIL DESCRIPTIONS OF THE INVENTION

All illustrations of the drawings are for the purpose of describing selected versions of the present invention and are not intended to limit the scope of the present invention.

In reference to FIGS. 1 through 7, the present invention is an oilfield casing centralization tool that allows a user to center the casing to install a casing hanger into the bowl profile of a wellhead to support the weight of the casing which can exceed over one million pounds. In the preferred embodiment, the present invention comprises a push jack assembly 1, an anchoring jack assembly 15, and an elongated structural member 26. The anchoring jack assembly 15 allows a user to fully secure the present invention to a bolt hole of the wellhead. With the present invention fully secured to the wellhead, the push jack assembly 1 allows a user to push the casing a desired distance in order to center the casing within a wellbore. The elongated structural member 26 serves as a rigid hub for the push jack assembly 1 and the anchoring jack assembly 15.

Figure 1:
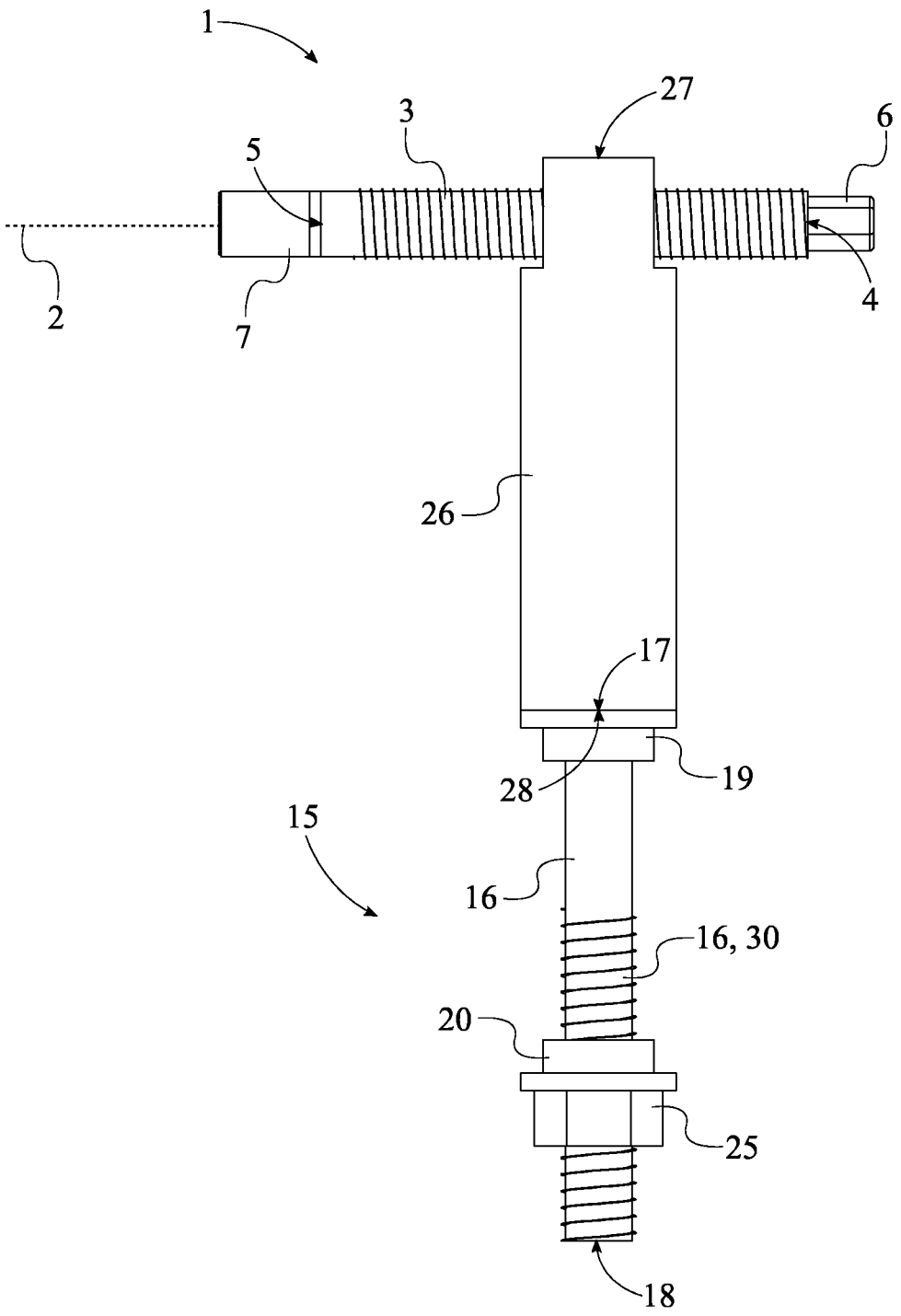
FIG. 1 is a front view of the present invention.
Figure 2:
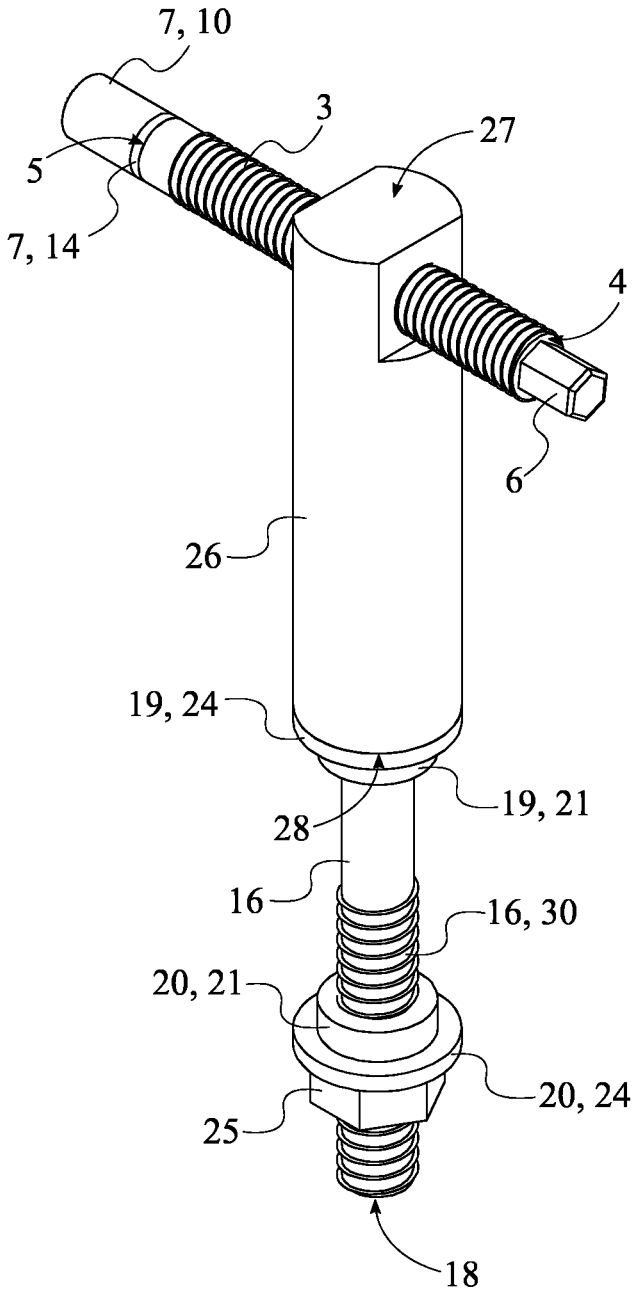
FIG. 2 is a front top perspective view of the present invention.
Figure 3:
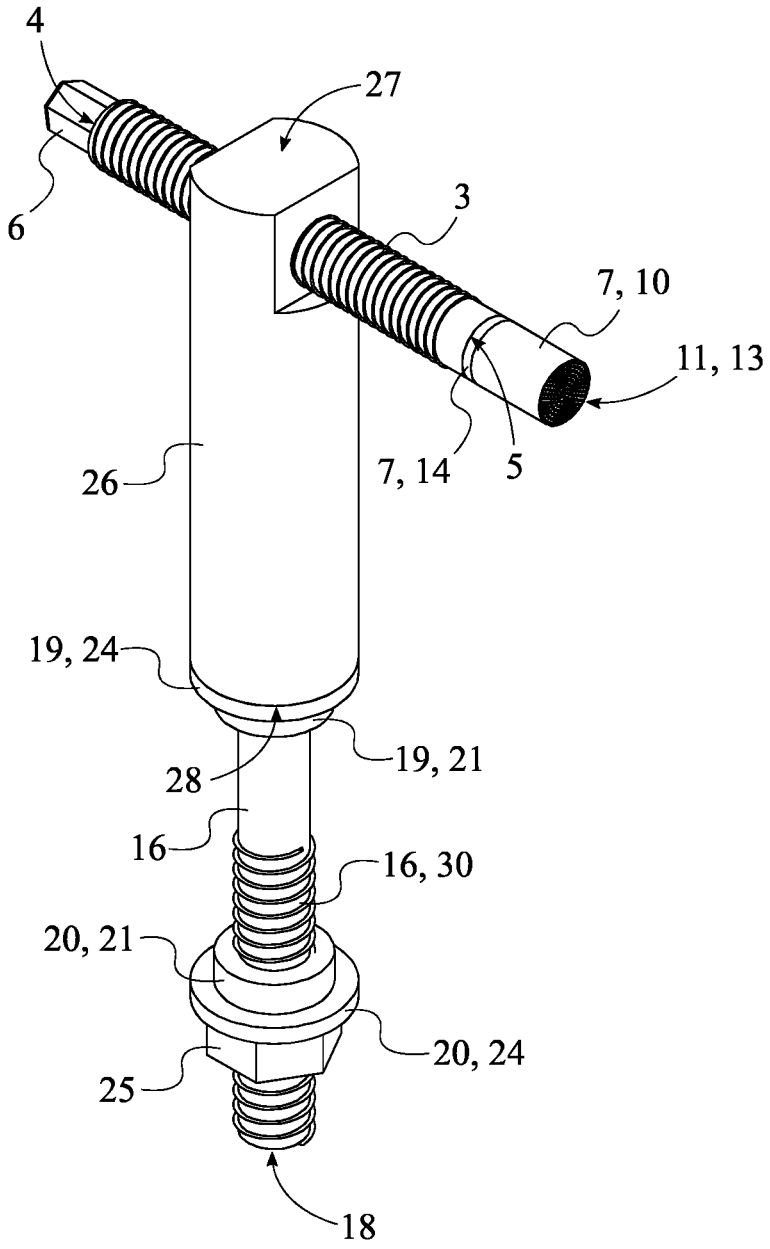
FIG. 3 is a rear top perspective view of the present invention.
Figure 4:
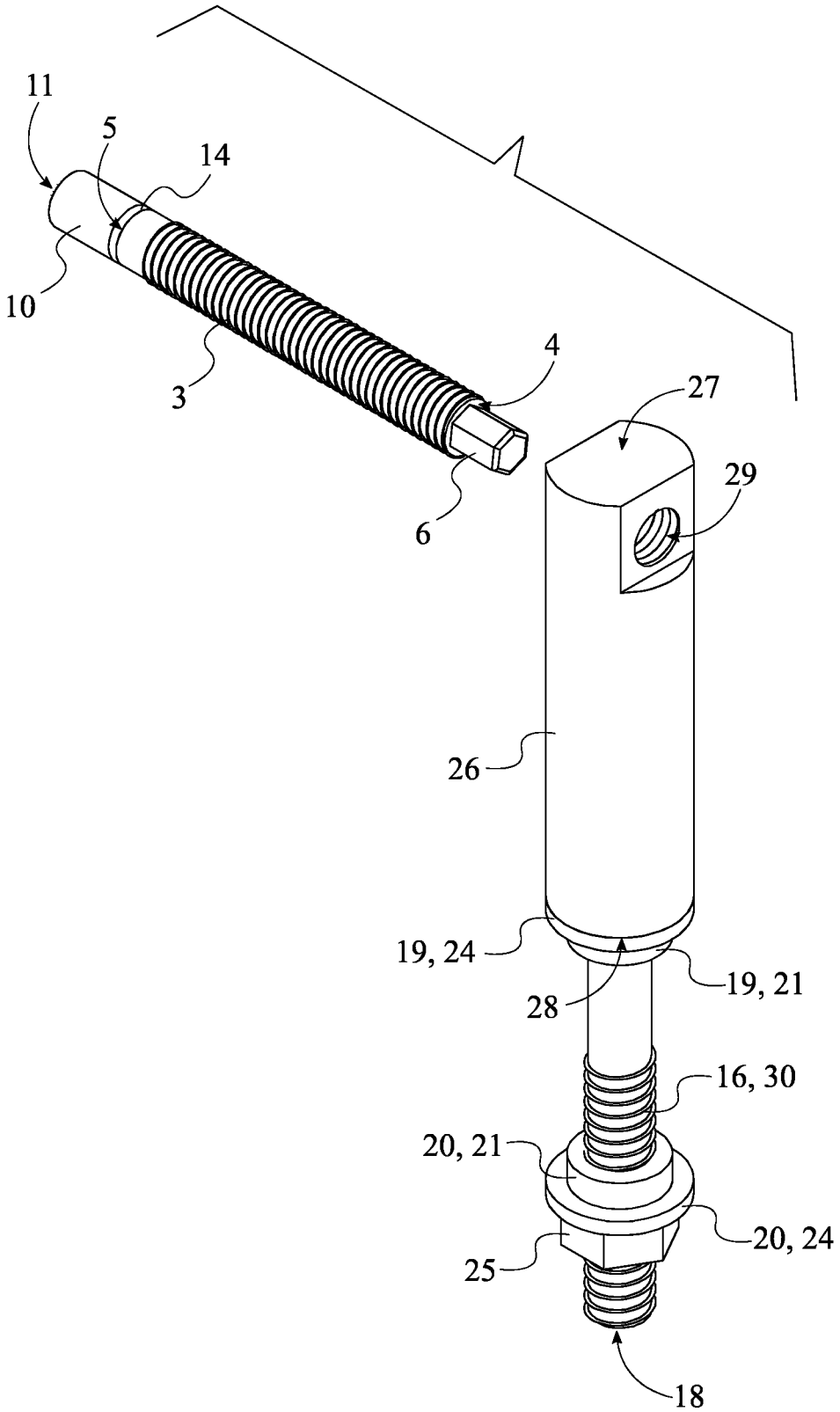
FIG. 4 is an exploded front top perspective view of the present invention.

The general configuration of the aforementioned components allows a user to center a casing within a wellbore using the present invention. With reference to FIGS. 1 through 3, the elongated structural member 26 comprises a first member end 27 and a second member end 28. The push jack assembly 1 is operatively integrated through the first member end 27, wherein the push jack assembly 1 is used to apply a push force from the first member end 27 along a force application axis 2. In further detail, the push jack assembly 1 is turned using a fastener tool such as, but not limited to, an impact wrench, a ratchet wrench, or an adjustable wrench. This causes the push jack assembly 1 to traverse through the elongated structural member 26 and, thus, apply the push force onto the casing. The force application axis 2 is positioned perpendicular to the elongated structural member 26. The force application axis 2 is preferably a horizontal force axis in which the casing is translated along in order to center the casing within a wellbore. The anchoring jack assembly 15 is operatively coupled to the second member end 28, wherein the anchoring jack assembly 15 is used to attach the second member end 28 to a wellhead 31, and the present invention can be used on any wellhead regardless of the size of the wellhead. In further detail, the present invention can be fully secured to a wellhead through the anchoring jack assembly 15. This prevents any vertically axial movement and rotational movement of the elongated structural member 26 when the push jack assembly 1 is used to apply the push force onto the casing.

In order for the push jack assembly 1 to be operatively coupled to the elongated structural member 26 and for the push jack assembly 1 to apply a push force and with reference to FIG. 2, the elongated structural member 26 further comprises a female-threaded hole 29, and the push jack assembly 1 comprises a male-threaded rod 3, a tool-engagement feature 6, and a push pin mechanism 7. The tool-engagement feature 6 allows a user to apply a torque force onto the push jack assembly 1 by using a fastener tool. In further detail, the tool-engagement feature 6 is preferably a hexagonal prismatic nub that can be engaged by fastener tool. The push pin mechanism 7 is designed to effectively apply the push force onto a casing and to prevent any damage to the casing. The male-threaded 3 comprises a first rod end 4 and a second rod end 5. The tool-engagement feature 6 is connected adjacent to the first rod end 4 in order for push jack assembly 1 to be easily engaged by a fastener tool, and for the fastener tool to apply an optimal torque force to the push jack assembly 1. The push pin mechanism 7 is rotatably mounted to second rod end 5 in order to prevent the push pin mechanism 7 from rotating with the male-threaded rod 3 when a torque force is applied to the push jack assembly 1 and while being pushed by the male-threaded rod 3 to apply the push force to a casing. Further and with reference to FIG. 4, the female-threaded hole 29 is integrated into the first member end 27, and the female-threaded hole 29 is engaged by the male-threaded rod 3. This arrangement allows the male-threaded rod 3 to move through the female-threaded hole 29 when a torque force is applied to the push jack assembly 1.

Figure 5:
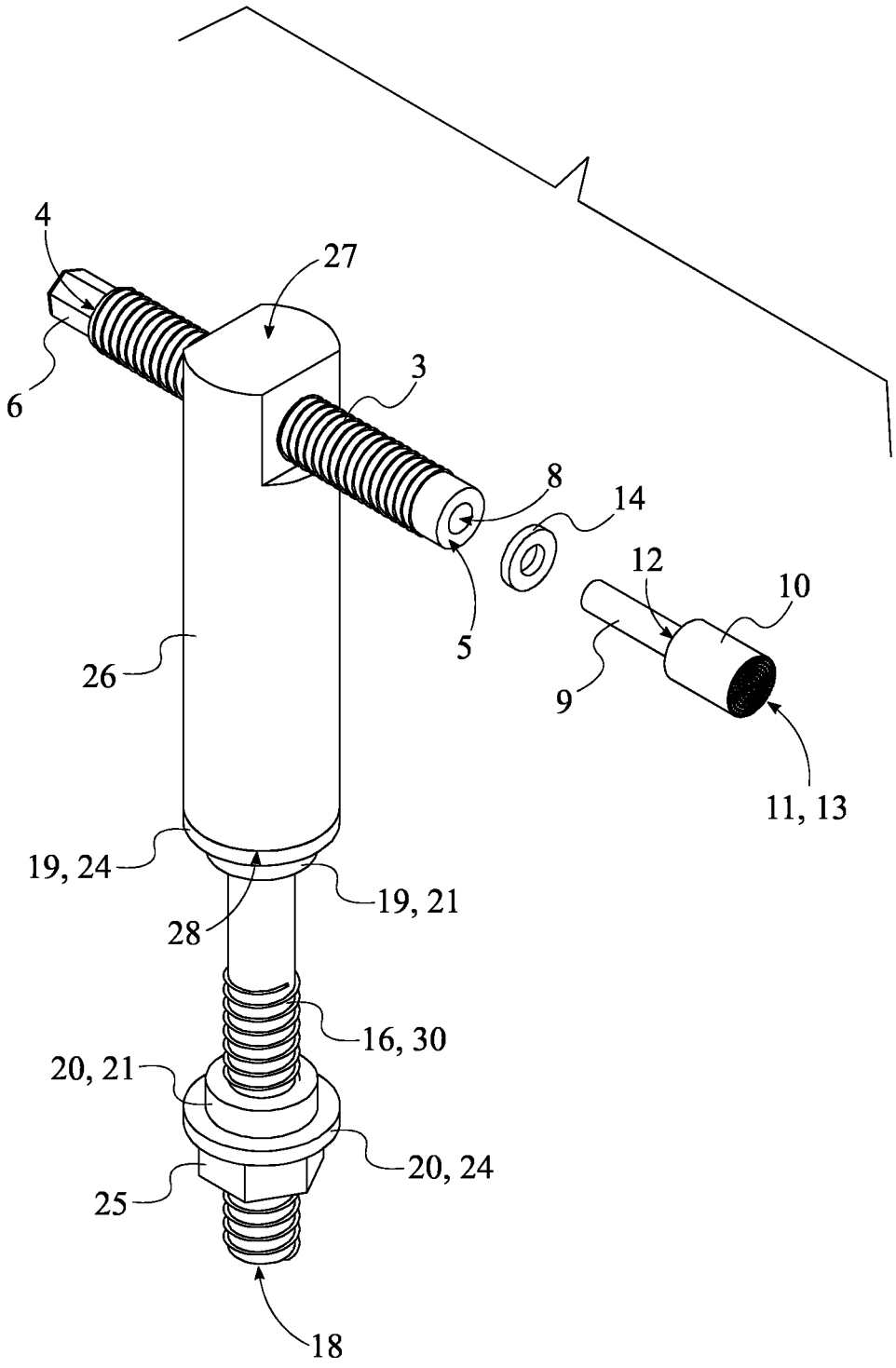
FIG. 5 is an exploded rear top perspective view of the present invention.

In order for the push pin mechanism 7 to effectively apply the push force onto a casing without causing damage to the casing and with reference to FIGS. 2 and 5, the push pin mechanism 7 comprises an axial cavity 8, an axial pin 9, a bracing head 10, and a grip feature 13. The bracing head 10 comprises a first an axial cavity 8, an axial pin 9, a bracing head 10, and a grip feature 13. The bracing head 10 is used to engage the push pin mechanism 7 to a casing. The bracing head 10 comprises a first head base 11 and a second head base 12. The first head base 11 and the second head base 12 are positioned opposite to each about the bracing head 10. The axial cavity 8 traverses into the male-threaded rod 3 from the first rod end 4, and the axial pin 9 is rotatably engaged into the axial cavity 8. This arrangement prevents the push pin mechanism 7 from rotating with the male-threaded rod 3 when a torque force is applied to the push jack assembly 1. Further, the axial cavity 8 and the axial pin 9 are positioned coincident along the force application axis 2, and the axial pin 9 is torsionally connected to the second head base 12. This arrangement allows the push pin mechanism 7 to axially move with male-threaded rod 3 when a torque force is applied to the push jack assembly 1. Thus, the push pin mechanism 7 can apply the push force to a casing. Moreover, the grip feature 13 is integrated across the first head base 11. This allows the grip feature 13 to effectively contact a casing, and therefore, the bracing head 10 is prevented from slipping off the casing when the push force is being applied to the casing. The grip feature 13 is preferably a knurled surface that creates friction between the bracing head 10 and the casing.

In order to reduce any friction between the push pin mechanism 7 and the male-threaded rod 3 and with reference to FIG. 5, the push pin mechanism 7 further comprises an interfacing ring 14. In further detail, when a torque force is applied to the push jack assembly 1, the male-threaded rod 3 will rotate to axially move through the female-threaded hole 29. As the male-threaded rod 3 rotates, the male-threaded rod 3 constantly rubs against the push pin mechanism 7. The axial pin 9 is positioned through the interfacing ring 14, and the interfacing ring 14 is positioned in between the second head base 12 and the first rod end 4. This arrangement reduces friction between the push pin mechanism 7 and the male-threaded rod 3, and therefore, any damage is reduced to the push pin mechanism 7 and the male-threaded rod 3.

In order for the present invention to be effectively attached to different sized wellheads and with reference to FIG. 3, the anchoring jack assembly 15 comprises an anchor rod 16, a first washer 19, a second washer 20, and at least one female-threaded nut 25. The anchor rod 16 comprises a proximal end 17, a distal end 18, and a male-threaded portion 30. The proximal end 17 is connected adjacent to the second member end 28. This arrangement establishes an association between the anchoring jack assembly 15 and the push jack assembly 1 through the elongated structural member 26. The male-threaded portion 30 allows the anchor rod 16 to be engaged to fasteners such as nuts. The male-threaded portion 30 is laterally integrated into the anchor rod 16, is positioned offset from proximal end 17, and is positioned adjacent to the distal end 18. This arrangement allows only part of the anchor rod 16 to engage to fasteners starting from the distal end 18. The anchor rod 16 is positioned through the first washer 19 and through the second washer 20. Through this arrangement, the first washer 19 and the second washer 20 can brace the walls of a wellhead while the anchoring jack assembly 15 is engaged to the bolt hole of the wellhead. The first washer 19 and the second washer 20 are positioned in between the proximal end 17 and the at least one female-threaded nut 25. This arrangement allows the first washer 19 and the second washer 20 to be positioned at a desired offset distance from each other to brace the walls of different sized wellheads. Further, the at least one female-threaded nut 25 is engaged by the male-threaded portion 30. This arrangement locks the desired offset distance between the first washer 19 and the second washer 20 with the at least one female-threaded nut 25 when the first washer 19 and the second washer 20 are bracing the walls of the wellhead.

Figure 6:
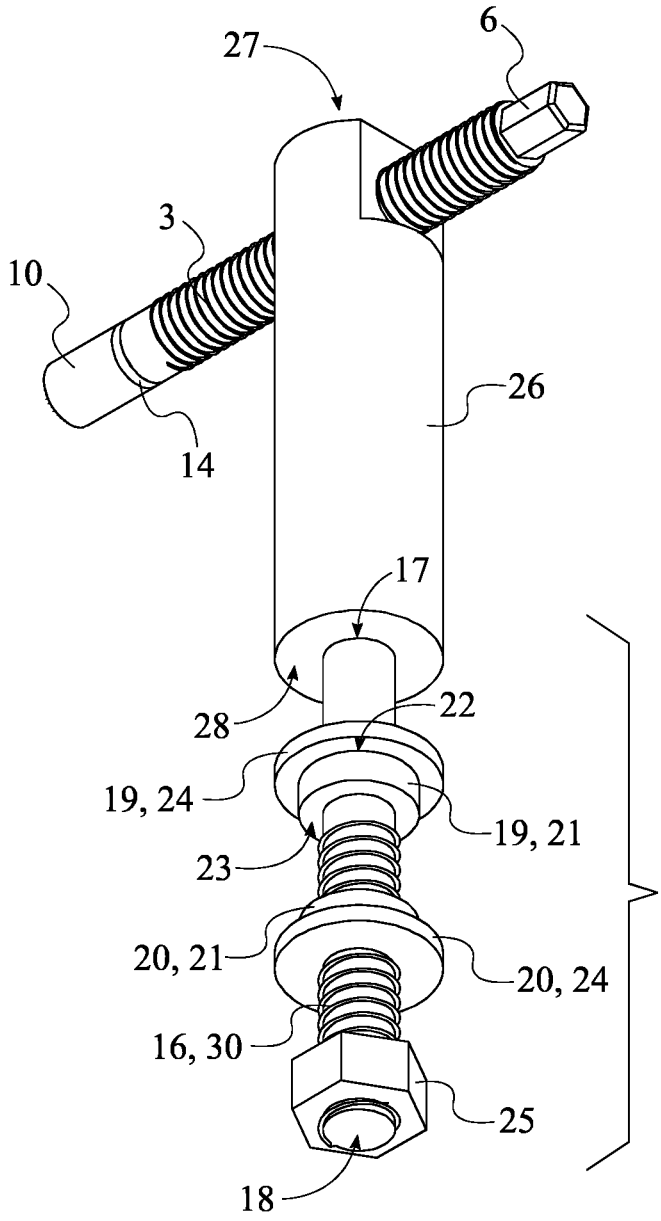
FIG. 6 is an exploded front bottom perspective view of the present invention.
Figure 7:
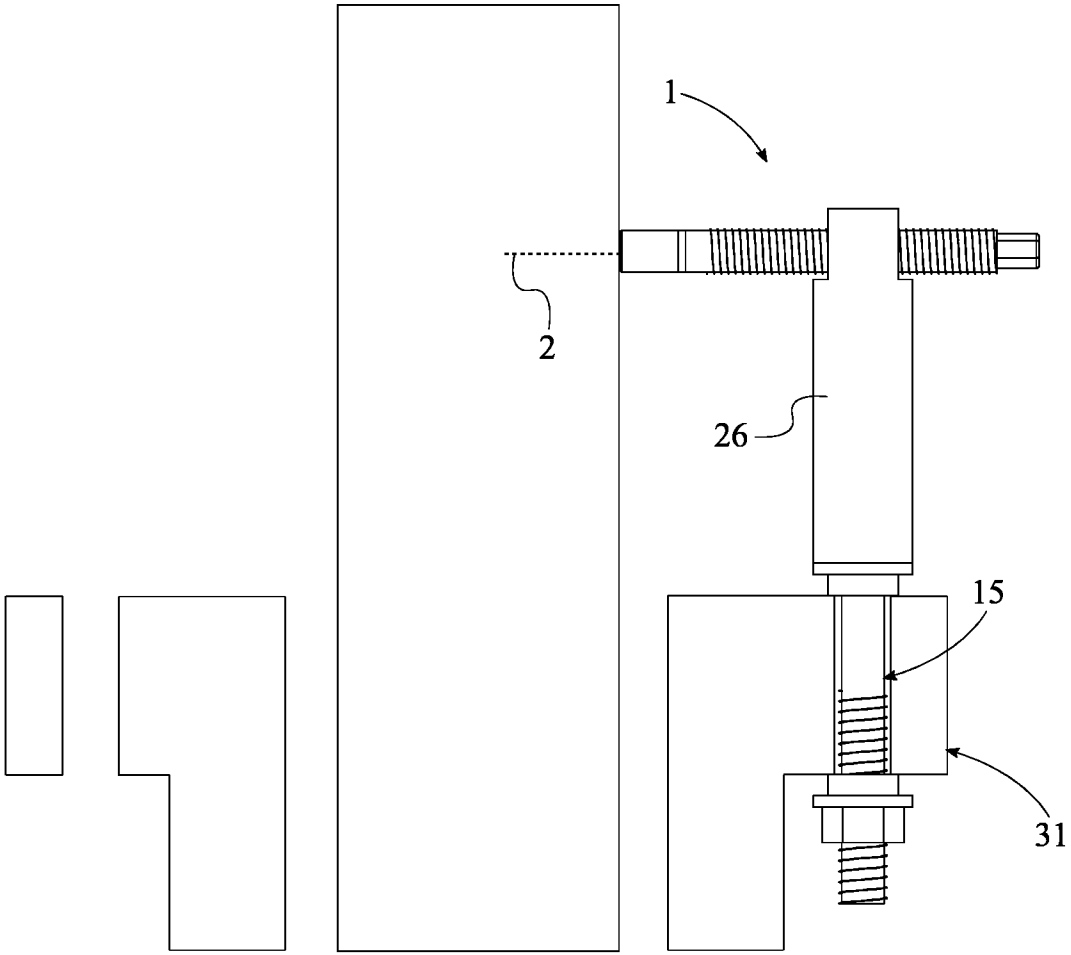
FIG. 7 is a front view of the present invention engaged to a casing while fully secured to a wellhead.

In order for the first washer 19 and the second washer 20 to brace the walls of the wellhead and with reference to FIGS. 3 and 6, the first washer 19 and the second washer 20 each comprise an annular body 21 and a flange 24. The annular body 21 comprises a first open end 22 and a second open end 23. The flange 24 is perimetrically connected around the first open end 22. This arrangement allows the flange 24 to brace a wall of the wellhead. Further, the flange 24 of the first washer 19 is positioned against the second member end 28 in order for the first washer 19 to brace a top wall of the wellhead. Moreover and with reference to FIG. 7, the first washer 19 is pressed in between by the second member end 28 and the top wall of the wellhead. The flange 24 of the second washer 20 is positioned against the at least one female-threaded nut 25. This arrangement allows the second washer 20 to brace the bottom wall of the wellhead. Moreover and with reference to FIG. 7, the second washer 20 is pressed in between the at least one female-threaded nut 25 and the bottom wall of the wellhead.

Although the invention has been explained in relation to its preferred embodiment, it is to be understood that many other possible modifications and variations can be made without departing from the spirit and scope of the invention as hereinafter claimed.

What is claimed is:

1. An oilfield casing centralization tool comprising:

a push jack assembly;

an anchoring jack assembly;

an elongated structural member;

the elongated structural member comprising a first member end and a second member end;

the push jack assembly being operatively integrated through the first member end, wherein the push jack assembly is used to apply a push force from the first member end along a force application axis;

the force application axis being positioned perpendicular to the elongated structural member; and the anchoring jack assembly being operatively coupled to the second member end, wherein the anchoring jack assembly is used to attach the second member end to a wellhead.

2. The oilfield casing centralization tool as claimed in claim 1 comprising:

the elongated structural member further comprising a female-threaded hole;

the push jack assembly comprising a male-threaded rod, a tool-engagement feature, and a push pin mechanism;

the male-threaded rod comprising a first rod end and a second rod end;

the tool-engagement feature being connected adjacent to the first rod end;

the push pin mechanism being rotatably mounted to the second rod end;

the female-threaded hole being integrated into the first member end; and the female-threaded hole being engaged by the male-threaded rod.

3. The oilfield casing centralization tool as claimed in claim 2 comprising:

the push pin mechanism comprising an axial cavity, an axial pin, a bracing head, and a grip feature;

the bracing head comprising a first head base and a second head base;

the first head base and the second head base positioned opposite to each other about the bracing head;

the axial cavity traversing into the male-threaded rod from the first rod end;

the axial pin being rotatably engaged into the axial cavity;

the axial cavity and the axial pin being positioned coincident along the force application axis;

the axial pin being torsionally connected to the second head base; and the grip feature being integrated across the first head base.

4. The oilfield casing centralization tool as claimed in claim 3 comprising:

the push pin mechanism further comprising an interfacing ring;

the axial pin being positioned through the interfacing ring; and the interfacing ring being positioned in between the second head base and the first rod end.

5. The oilfield casing centralization tool as claimed in claim 3, wherein the grip feature is a knurled surface.

6. The oilfield casing centralization tool as claimed in claim 2, wherein the tool-engagement feature is a hexagonal prismatic nub.

7. The oilfield casing centralization tool as claimed in claim 1 comprising:

the anchoring jack assembly comprising an anchor rod, a first washer, a second washer, and at least one female-threaded nut;

the anchor rod comprising a proximal end, a distal end, and a male-threaded portion;

the proximal end being connected adjacent to the second member end;

the male-threaded portion being laterally integrated into the anchor rod;

the male-threaded portion being positioned offset from the proximal end;

the male-threaded portion being positioned adjacent to the distal end;

the anchor rod being positioned through the first washer and through the second washer;

the first washer and the second washer being positioned in between the proximal end and the at least one female-threaded nut; and the at least one female-threaded nut being engaged by the male-threaded portion.

8. The oilfield casing centralization tool as claimed in claim 7 comprising:

the first washer and the second washer each comprising an annular body and a flange;

the annular body comprising a first open end and a second open end;

the flange being perimetrically connected around the first open end;

the flange of the first washer being positioned against the second member end; and the flange of the second washer being positioned against the at least one female-threaded nut.

9. An oilfield casing centralization tool comprising:

a push jack assembly;

an anchoring jack assembly;

an elongated structural member;

the elongated structural member comprising a first member end, a second member end, and a female-threaded hole;

the push jack assembly comprising a male-threaded rod, a tool-engagement feature, and a push pin mechanism;

the anchoring jack assembly comprising an anchor rod, a first washer, a second washer, and at least one female-threaded nut;

the anchor rod comprising a proximal end, a distal end, and a male-threaded portion;

the proximal end being connected adjacent to the second member end;

the push jack assembly being operatively integrated through the first member end, wherein the push jack assembly is used to apply a push force from the first member end along a force application axis;

the force application axis being positioned perpendicular to the elongated structural member;

the anchoring jack assembly being operatively coupled to the second member end, wherein the anchoring jack assembly is used to attach the second member end to a wellhead;

the male-threaded rod comprising a first rod end and a second rod end;

the tool-engagement feature being connected adjacent to the first rod end;

the push pin mechanism being rotatably mounted to the second rod end;

the female-threaded hole being integrated into the first member end;

the female-threaded hole being engaged by the male-threaded rod;

the male-threaded portion being laterally integrated into the anchor rod;

the male-threaded portion being positioned offset from the proximal end;

the male-threaded portion being positioned adjacent to the distal end;

the anchor rod being positioned through the first washer and through the second washer;

the first washer and the second washer being positioned in between the proximal end and the at least one female-threaded nut; and the at least one female-threaded nut being engaged by the male-threaded portion.

10. The oilfield casing centralization tool as claimed in claim 9 comprising:

the push pin mechanism comprising an axial cavity, an axial pin, a bracing head, and a grip feature;

the bracing head comprising a first head base and a second head base;

the first head base and the second head base positioned opposite to each other about the bracing head;

the axial cavity traversing into the male-threaded rod from the first rod end;

the axial pin being rotatably engaged into the axial cavity;

the axial cavity and the axial pin being positioned coincident along the force application axis;

the axial pin being torsionally connected to the second head base; and the grip feature being integrated across the first head base.

11. The oilfield casing centralization tool as claimed in claim 10 comprising:

the push pin mechanism further comprising an interfacing ring;

the axial pin being positioned through the interfacing ring; and the interfacing ring being positioned in between the second head base and the first rod end.

12. The oilfield casing centralization tool as claimed in claim 10, wherein the grip feature is a knurled surface.

13. The oilfield casing centralization tool as claimed in claim 9, wherein the tool-engagement feature is a hexagonal prismatic nub.

14. The oilfield casing centralization tool as claimed in claim 9 comprising:

the first washer and the second washer each comprising an annular body and a flange;

the annular body comprising a first open end and a second open end;

the flange being perimetrically connected around the first open end;

the flange of the first washer being positioned against the second member end; and the flange of the second washer being positioned against the at least one female-threaded nut.

15. An oilfield casing centralization tool comprising:

a push jack assembly;

an anchoring jack assembly;

an elongated structural member;

the elongated structural member comprising a first member end, a second member end, and a female-threaded hole;

the push jack assembly comprising a male-threaded rod, a tool-engagement feature, and a push pin mechanism;

the anchoring jack assembly comprising an anchor rod, a first washer, a second washer, and at least one female-threaded nut;

the anchor rod comprising a proximal end, a distal end, and a male-threaded portion;

the push pin mechanism comprising an axial cavity, an axial pin, a bracing head, and a grip feature;

the bracing head comprising a first head base and a second head base;

the push jack assembly being operatively integrated through the first member end, wherein the push jack assembly is used to apply a push force from the first member end along a force application axis;

the force application axis being positioned perpendicular to the elongated structural member;

the anchoring jack assembly being operatively coupled to the second member end, wherein the anchoring jack assembly is used to attach the second member end to a wellhead;

the male-threaded rod comprising a first rod end and a second rod end;

the tool-engagement feature being connected adjacent to the first rod end;

the push pin mechanism being rotatably mounted to the second rod end;

the female-threaded hole being integrated into the first member end;

the female-threaded hole being engaged by the male-threaded rod;

the proximal end being connected adjacent to the second member end;

the male-threaded portion being laterally integrated into the anchor rod;

the male-threaded portion being positioned offset from the proximal end;

the male-threaded portion being positioned adjacent to the distal end;

the anchor rod being positioned through the first washer and through the second washer;

the first washer and the second washer being positioned in between the proximal end and the at least one female-threaded nut;

the at least one female-threaded nut being engaged by the male-threaded portion;

the first head base and the second head base positioned opposite to each other about the bracing head;

the axial cavity traversing into the male-threaded rod from the first rod end;

the axial pin being rotatably engaged into the axial cavity;

the axial cavity and the axial pin being positioned coincident along the force application axis;

the axial pin being torsionally connected to the second head base; and the grip feature being integrated across the first head base.

16. The oilfield casing centralization tool as claimed in claim 15 comprising:

the push pin mechanism further comprising an interfacing ring;

the axial pin being positioned through the interfacing ring; and the interfacing ring being positioned in between the second head base and the first rod end.

17. The oilfield casing centralization tool as claimed in claim 15, wherein the grip feature is a knurled surface.

18. The oilfield casing centralization tool as claimed in claim 15, wherein the tool-engagement feature is a hexagonal prismatic nub.

19. The oilfield casing centralization tool as claimed in claim 15 comprising:

the first washer and the second washer each comprising an annular body and a flange;

the annular body comprising a first open end and a second open end;

the flange being perimetrically connected around the first open end;

the flange of the first washer being positioned against the second member end; and the flange of the second washer being positioned against the at least one female-threaded nut.

* * * * *